US009220380B2

(12) United States Patent
Gluck

(10) Patent No.: US 9,220,380 B2
(45) **Date of Patent: *Dec. 29, 2015**

(54) DISPOSABLE ANTI VIRAL TISSUE DISPENSER AND DISPOSAL STRUCTURE

(71) Applicant: Adrian Gluck, Beverly Hills, CA (US)

(72) Inventor: Adrian Gluck, Beverly Hills, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/593,868

(22) Filed: Jan. 9, 2015

(65) Prior Publication Data

US 2015/0129604 A1 May 14, 2015

Related U.S. Application Data

(63) Continuation of application No. 14/135,479, filed on Dec. 19, 2013, now Pat. No. 8,960,494.

(60) Provisional application No. 61/962,667, filed on Nov. 12, 2013, provisional application No. 61/963,696, filed on Dec. 12, 2013.

(51) Int. Cl.

| | |
|---|---|
| ***A47K 10/42*** | (2006.01) |
| ***A47K 10/46*** | (2006.01) |
| ***B65D 83/08*** | (2006.01) |
| *A47K 10/32* | (2006.01) |

(52) U.S. Cl.

CPC ..... *A47K 10/46* (2013.01); *A47K 10/421* (2013.01); *B65D 83/0805* (2013.01); *B65D 83/0888* (2013.01); *A47K 2010/3233* (2013.01)

(58) Field of Classification Search

CPC ..... A47K 10/46

USPC ..... 221/33, 34, 35, 92, 97, 98, 99, 100, 221/101, 102

See application file for complete search history.

(56) References Cited

U.S. PATENT DOCUMENTS

| | | | | |
|---|---|---|---|---|
| 6,672,474 | B2 * | 1/2004 | May et al. | 221/34 |
| 6,702,147 | B2 * | 3/2004 | Ashford | 221/34 |
| 8,960,494 | B1 * | 2/2015 | Gluck | 221/102 |

FOREIGN PATENT DOCUMENTS

| | | | |
|---|---|---|---|
| JP | 2000126068 A | * | 5/2000 |
| JP | 2003118783 A | * | 4/2003 |

* cited by examiner

*Primary Examiner* — Patrick Mackey

(74) *Attorney, Agent, or Firm* — Smyrski Law Group, A P.C.

(57) ABSTRACT

An integrated tissue dispensing apparatus is provided. The apparatus includes a tissue dispensing container configured to hold at least one tissue, the tissue dispensing container comprising a front face, a top face, a back face positioned opposite to the front face, a left side face, a bottom face, and a right side face positioned opposite to the left side face and a disposal receptacle formed with and fixedly adjoined to the hollow dispensing container and comprising a receptacle bottom wall connected to the back face of the dispensing container, the receptacle bottom wall formed with and fixedly adjoined to a receptacle back wall of the disposal receptacle. The disposal receptacle is in a closed position covering the top face of the tissue dispensing container and is movable to an open position exposing the top face of the tissue dispensing container. The device may be constructed of cardboard, for example.

21 Claims, 7 Drawing Sheets

DISPOSABLE ANTI VIRAL TISSUE DISPENSER AND DISPOSAL STRUCTURE

CROSS-REFERENCES TO RELATED APPLICATIONS

This application is a continuation of currently pending U.S. patent application Ser. No. 14/135,479, filed Dec. 19, 2013, entitled "Disposable Anti-Viral Tissue Dispenser and Disposal Structure," inventor Adrian Gluck, which claims the benefit of, and priority to, U.S. Provisional Patent Application Ser. No. 61/962,667, filed on Nov. 11, 2013, entitled "Disposable Tissue Box with Built-in Trash Receptacle," inventor Adrian Gluck, and U.S. Provisional Patent Application No. 61/963,696, filed on Dec. 12, 2013, entitled "Disposable anti-viral tissue dispenser and disposal structure," both of which are hereby incorporated herein by reference in their entireties.

BACKGROUND OF THE INVENTION

1. Field of the Invention

The present invention relates to providing a safe and convenient structure for customers in disposing used facial tissues.

2. Description of the Related Art

Generally, people do not have ready access to a means of disposing used facial tissues. Many people who use tissues from a tissue box are seldom within reach of a disposal bin, and therefore they tend put used tissues on a surface and contaminate the surface. These actions can spread illness and disease, especially during flu season, since bacteria and viruses are known to survive on hard surfaces for up to two days and on used tissues for up to twelve hours. Even tissues that include antibacterial treatments do not inhibit the spread of bacteria on surfaces that touch the material in the tissue. Flu viruses and other infections may be easily spread in this way, either from contact with used tissues that have not been properly disposed, or from contact with surfaces contaminated by the discarded used tissues. People who work in the janitorial and cleaning industries are particularly at risk since they have the task of cleaning up used tissues and disposing of them in trash bins, thus exposing themselves to the bacteria and viruses on the tissues and the surfaces on which the tissues were discarded.

Therefore, it would be desirable to provide a design that decreases or minimizes the risk of spread of bacteria and viruses from used facial tissues by enabling the user to directly and immediately dispose of these used tissues without the issues associated with previous disposal methods, providing a safe and inexpensive disposal method that is neither cumbersome nor occupies a relatively large area.

SUMMARY OF THE INVENTION

According to one aspect of the present design, there is provided an integrated apparatus for the dispensing and disposing of tissues that includes a hollow dispensing container and a foldable trash disposal receptacle.

According to one aspect of the present design, there is provided an integrated tissue dispensing apparatus. The apparatus includes a hollow dispensing container configured to hold at least one tissue, the hollow dispensing container comprising a front face, a top face, a back face positioned opposite to the front face, a left side face, a bottom face, and a right side face positioned opposite to the left side face, and a foldable trash disposal receptacle formed with and fixedly adjoined to the hollow dispensing container and comprising a receptacle bottom wall connected to the back face of the dispensing container. The foldable trash receptacle is configured to fold between a closed position and an open position relative to the dispensing container.

According to another aspect of the present design, there is provided an integrated tissue dispensing apparatus comprising a multi-panel single semi-rigid foldable piece that when assembled forms a dispensing container having a front face, a top face, a back face positioned opposite the front face, a left side face, a bottom face positioned opposite the top face, and a right side face positioned opposite the left side face, and a foldable trash disposal receptacle having a receptacle bottom wall, a receptacle back wall, a receptacle left side wall, and a right side wall positioned opposite the left side wall, wherein the receptacle bottom wall is connected to the back face of the dispensing container such that the receptacle folds between a closed position and an open position relative to the dispensing container.

According to a further embodiment, there is provided an integrated tissue dispensing apparatus that includes a multi-panel single semi-rigid foldable piece that when assembled forms a hollow dispensing container having a front face, a top face, a back face opposite the front face, a left side face, a bottom face positioned opposite to the top face, and a right side face positioned opposite to the left side face, wherein said top face includes an aperture configured for removal of a tissue, and a foldable trash disposal receptacle having a receptacle bottom wall, a receptacle back wall, a receptacle left side wall, and a receptacle right side wall positioned opposite the receptacle left side wall. The receptacle bottom wall is connectably formed adjacent to the back face of the dispensing container using a perforated line such that the receptacle may fold between a closed position and an open position relative to the dispensing container.

These and other advantages of the present invention will become apparent to those skilled in the art from the following detailed description of the invention and the accompanying drawings.

BRIEF DESCRIPTION OF THE DRAWINGS

For a more complete understanding of the present disclosure, reference is now made to the following figures, wherein like reference numbers refer to similar items throughout the figures.

The exemplification set out herein illustrates particular embodiments, and such exemplification is not intended to be construed as limiting in any manner.

DETAILED DESCRIPTION OF THE INVENTION

The following description and the drawings illustrate specific embodiments sufficiently to enable those skilled in the art to make and use the structure described. Other embodiments may incorporate structural and other changes. Examples merely typify possible variations. Portions and features of some embodiments may be included in or substituted for those of others.

Figure 1:
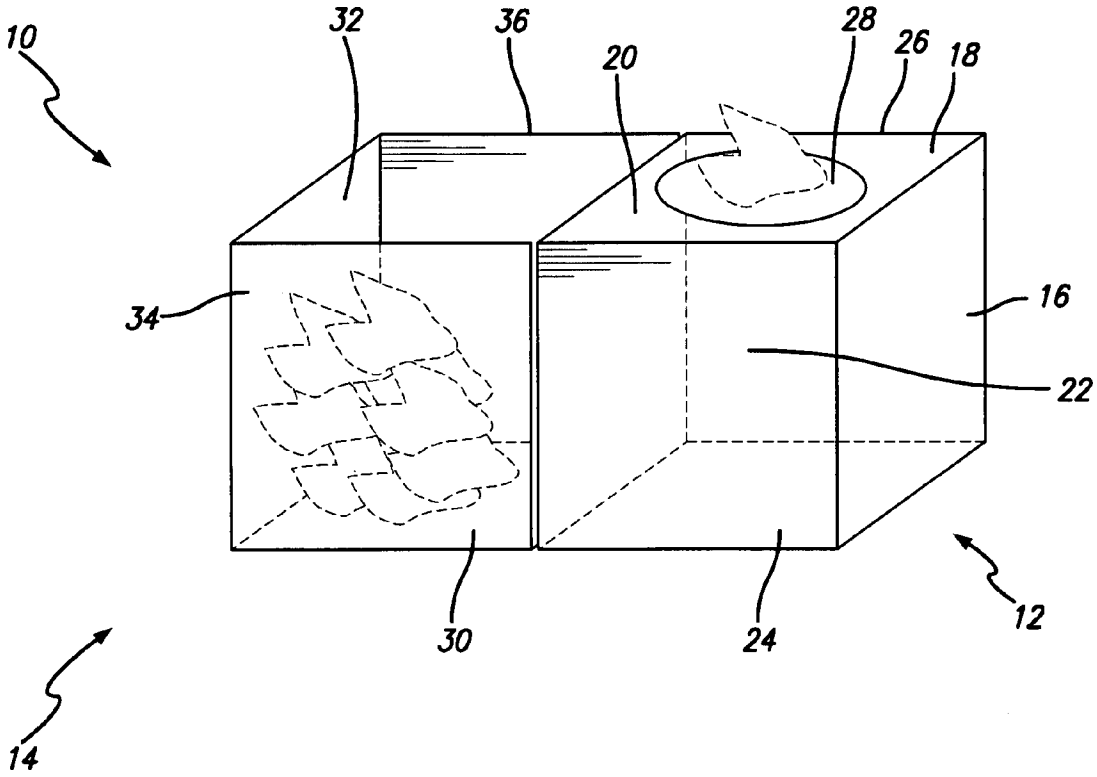
FIG. 1 illustrates a perspective view of the integrated apparatus for the dispensing and disposing of tissues in its opened position.

Referring now to the drawings, FIG. 1 illustrates an embodiment of an integrated apparatus 10 for the dispensing and disposing of tissues. The apparatus includes a hollow dispensing container 12 and a foldable trash disposal receptacle 14. The hollow dispensing container 12 is a box made up of a front face 16, a top face 18 connected to front face 16 at a right angle therewith, a back face 20 connected to top face 18 at a right angle therewith and positioned opposite to front face 16, a left side face 22 connected to top face 18 at a right angle therewith, a bottom face 24 connected to left side face 22 at a right angle therewith and positioned opposite to top face 18, and a right side face 26 connected to bottom face 24 at a right angle therewith and positioned opposite to left side face 22. The hollow dispensing container 12 typically contains tissues and similar paper products, for example cleaning and disinfecting wipes, which can be easily removed through an aperture 28 in top face 18. The hollow dispensing container 12 is made of material typically used to make boxes, such as cardboard.

In the embodiment depicted in FIG. 1, the foldable trash disposal receptacle 14 is made up of a bottom wall 30, a back wall 32 connected to bottom wall 30 at a right angle therewith, a left side wall 34 connected to back wall 32 at a right angle therewith, and a right side wall 36 connected to back wall 32 at a right angle therewith and positioned opposite to left side wall 34. In an embodiment, a user can dispose of used tissues and like paper products simply by placing them into the foldable trash disposal receptacle 14. The foldable trash disposal receptacle 14 is also made of material typically used to make boxes, such as cardboard.

Figure 2:
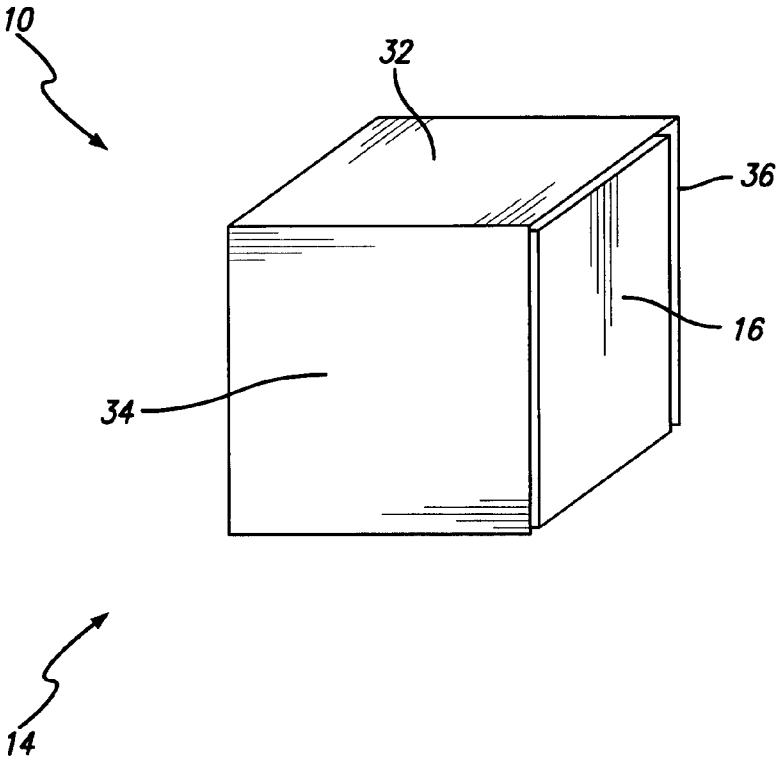
FIG. 2 illustrates a perspective view of the integrated apparatus in its closed position.
Figure 3:
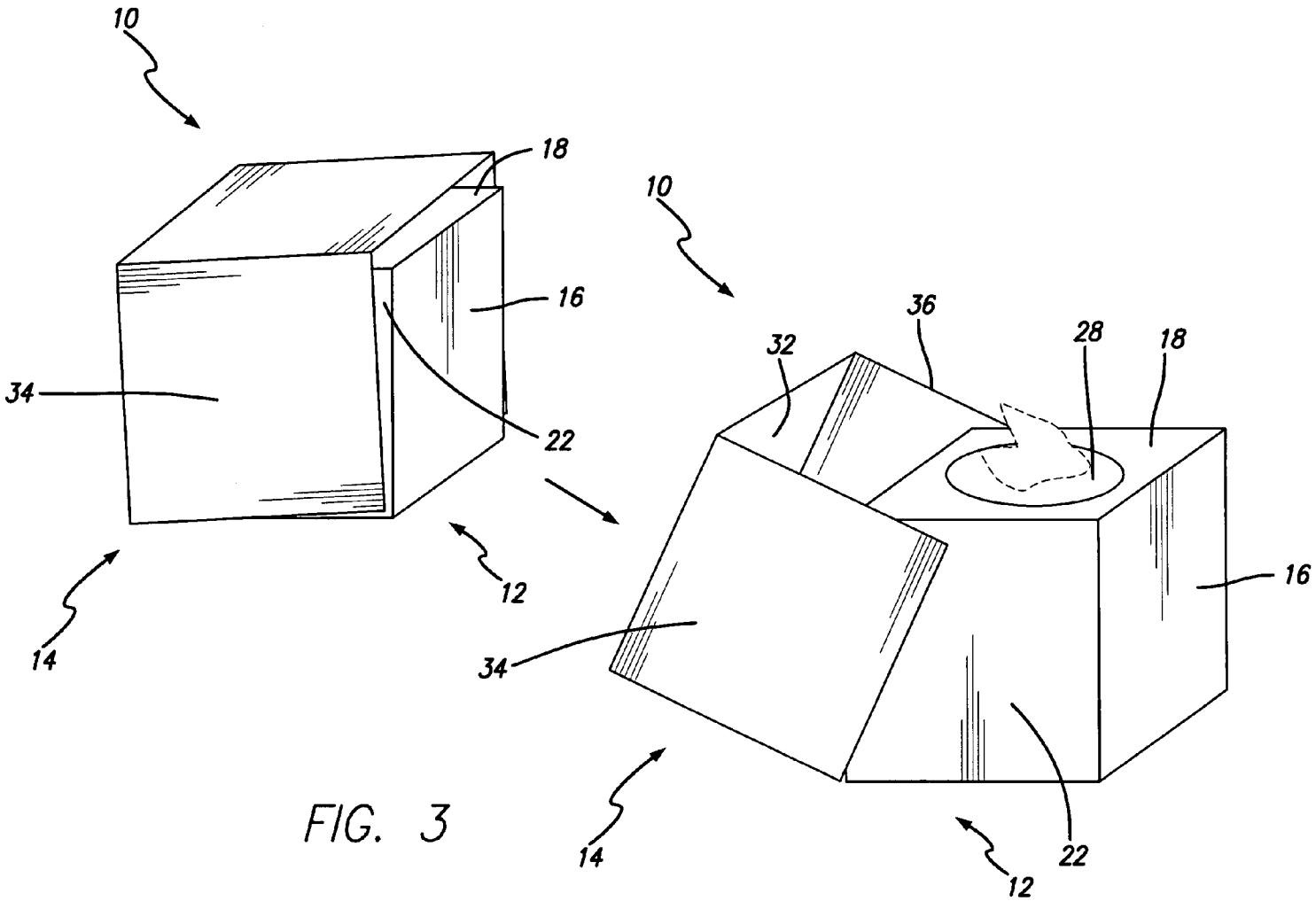
FIG. 3 is a perspective view of the transformation of the integrated apparatus between its closed and opened positions.

Referring now to FIG. 1, FIG. 2, and FIG. 3, the bottom wall 30 of trash disposal receptacle 14 is connected to the back face 20 of dispensing container 12 such that trash disposal receptacle 14 may fold between a closed position and an open position relative to dispensing container 12. FIG. 2 depicts the closed position of integrated apparatus 10, wherein trash disposal receptacle 14 occupies substantially the same footprint and space volume as dispensing container 12. Specifically, the closed position is such that left side face 22 wholly interfaces with left side wall 34, right side face 26 wholly interfaces with right side wall 36, and top face 18 wholly interfaces with back wall 32. The trash disposal receptacle 14 therefore does not possess all the facings of a box unlike the hollow dispensing container 12, thereby allowing the trash disposal receptacle 14 to be rotatably folded into the hollow dispensing container 12.

FIG. 1 depicts the opened position of integrated apparatus 10. The opened position is such that back face 20 is perpendicular to bottom wall 30, back face 20 is parallel to back wall 32, left side face 22 is parallel to left side wall 34, and right side face 26 is parallel to the right side wall 36. The trash disposal receptacle 14 can therefore be used while in its opened position and stored or carried while in its closed position. FIG. 3 depicts an embodiment of transforming the integrated apparatus 10 from a closed position into an opened position by folding and rotating the trash disposal receptacle 14 away from the hollow dispensing container 12.

Figure 4:
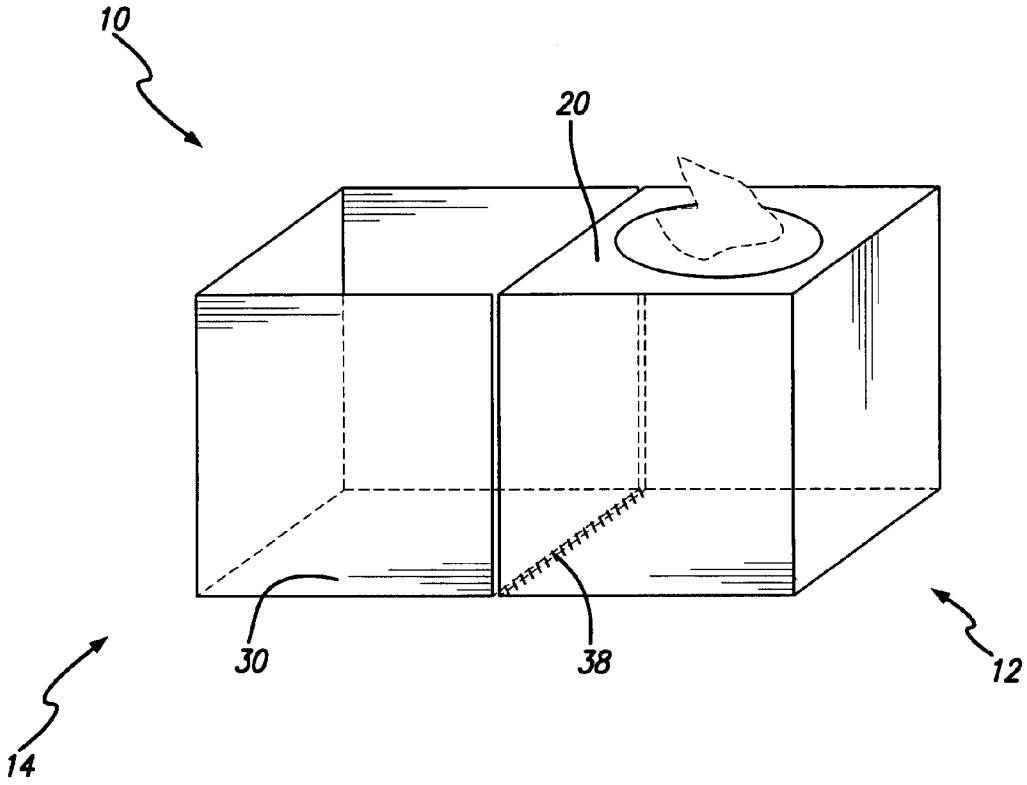
FIG. 4 shows a perspective view of an alternate embodiment of the integrated apparatus having a perforated line.

In another embodiment, shown in FIG. 4, the connection between back face 20 of dispensing container 12 and bottom wall 30 of trash disposal receptacle 14 is represented by perforated line 38. The dispensing container 12 and the trash disposal receptacle 14 may be separated along the perforated line 38 into distinct sections. This separation can be done if, for example, the user would like to dispose of the trash disposal receptacle 14 after a long period of use.

Figure 5:
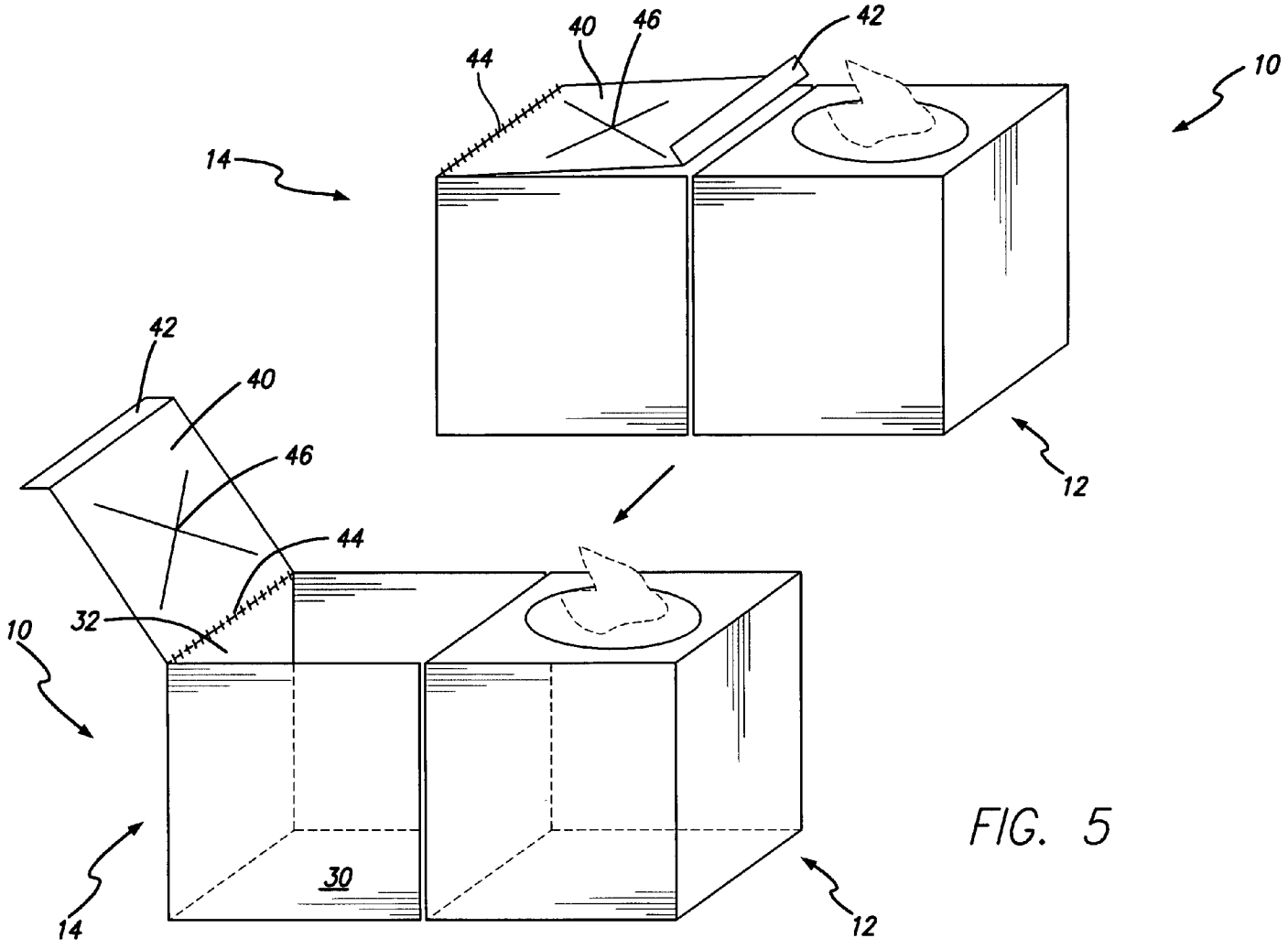
FIG. 5 illustrates a perspective view of the integrated apparatus having a foldable receptacle lid according to another embodiment.

FIG. 5 depicts a further embodiment wherein the trash disposal receptacle 14 includes a foldable receptacle lid 40. The foldable receptacle lid 40 is rotatably connected to the back wall 32 of the trash disposal receptacle 14 and is positioned opposite to the bottom wall 30 such that the user can rotatably open the receptacle lid 40 toward the back wall 32 and away from the bottom wall 30 before using the trash disposal receptacle 14. The receptacle lid 40 can also be folded into the trash disposal receptacle 14 such that it wholly interfaces with the back wall 32, allowing the trash disposal receptacle 14 to be rotated into its closed position relative to the hollow dispensing container 12 with ease. Thus, a user can open the foldable receptacle lid 40 before disposing of a tissue, and close the foldable receptacle lid 40 over the disposal receptacle 14 after use or even into the disposal receptacle 14 for storage or carrying.

In another embodiment, the foldable receptacle lid 40 may include a pull tab 42 positioned opposite to the back wall 32 of the trash disposal receptacle 14. The user may thus use the pull tab 42 when opening or closing the foldable receptacle lid 40.

In another embodiment, the foldable receptacle lid 40 may be separated from the back wall 32 of the trash disposal receptacle 14 by a scored line 44, thus allowing the receptacle lid 40 to be easily detached from the trash disposal receptacle 14 at the request of the user along the scored line 44. In another embodiment, the foldable receptacle lid 40 may optionally include tissue insertion slits 46 whereby the user may dispose of used tissues without needing to open the receptacle lid 40.

Figure 6:
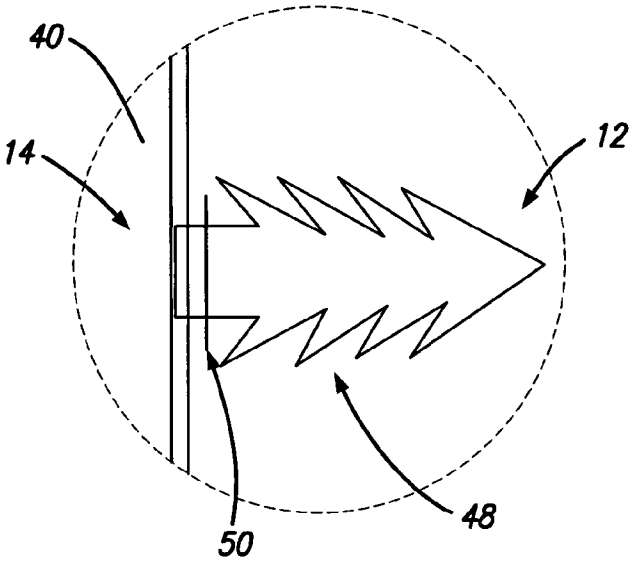
FIG. 6 is a perspective view of the embodiment of FIG. 5 including insertion tabs.
Figure 6:
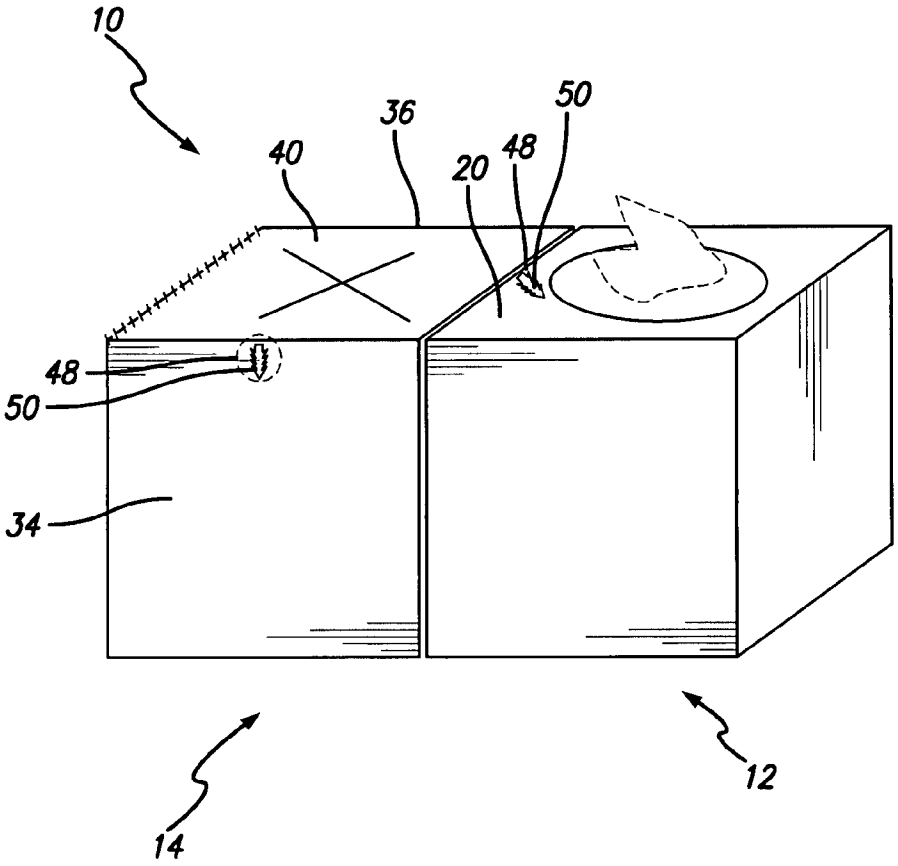

FIG. 6 depicts a further embodiment wherein the foldable receptacle lid 40 includes one or more insertion tabs 48 that may be used to interlock/connect the foldable receptacle lid 40 to one or more tab insertion slits 50 in the integrated apparatus 10. As used herein, the term "interlock/connect" or "interconnecting" is intended broadly and is intended to mean interlocking, connecting, interconnecting, interfacing, or any manner of interaction appropriate based on circumstances. The tab insertion slits 50 may be placed on, and thus allow the foldable receptacle lid 40 to fasten to, either or both the hollow dispensing container 12 and/or the trash disposal receptacle 14. Insertion tabs 48 extend from foldable receptacle lid 40, and tab insertion slits 50 may be placed inside left side wall 34 and right side wall 36 to fasten the foldable receptacle lid 40 to trash disposal receptacle 14. Moreover, tab insertion slits 50 may be placed inside back face 20 to fasten the foldable receptacle lid 40 to hollow dispensing container 12. The fastening can be done simply by pushing the insertion tabs 48 into the respective tab insertion slits 50. Each insertion tab 48 and respective tab insertion slit 50 may be marked so as to uniquely identify the respective tab-slit combination, preferably by using a sequential number indicative of the order in which the insertion tabs 48 should be inserted into the tab insertion slits 50. The user may thus interlock/connect the foldable receptacle lid 40 to the hollow dispensing container 12 in this manner in order to lock the integrated apparatus 10 into an opened position, or in order to prevent accidental detachment of the trash disposal receptacle 14 along the perforated line 38. Moreover, the user may choose to interlock/connect the foldable receptacle lid 40 to the trash disposal receptacle 14 in order to prevent accidental detachment of the foldable receptacle lid 40 along the scored line 44. As illustrated in FIG. 6, the insertion tabs 48 may, for example, be in a sawtooth form and slightly wider than the tab insertion slits 50, so that once inserted, the insertion tabs 48 can keep the foldable receptacle lid 40 rigidly connected to either the hollow dispensing container 12 or the trash disposal receptacle 14 even if moved about.

Figure 7:
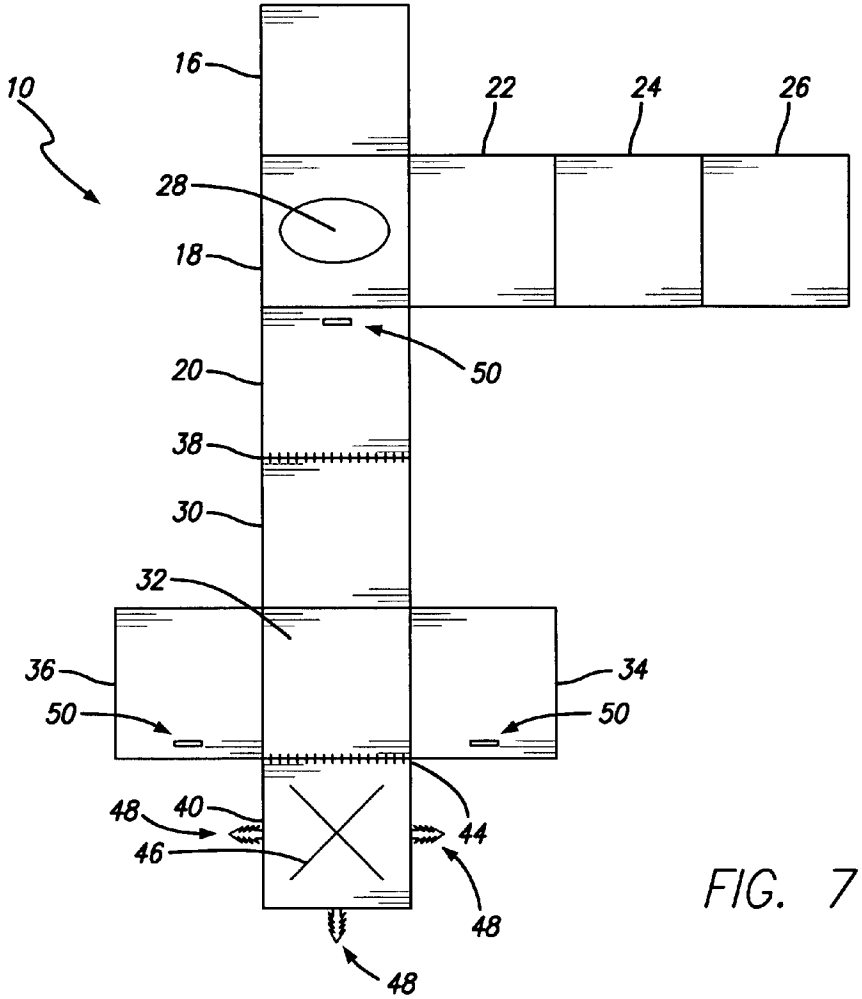
FIG. 7 shows a top plan view of a suggested die cut of the integrated apparatus.

In an embodiment, the integrated apparatus 10 can be manufactured from a single die cut and a single sheet of box material, such as cardboard. FIG. 7 depicts a suggested design of a die cut of the integrated apparatus 10. The integrated apparatus 10 can be manufactured using this die cut according to customary paper manufacturing standards.

As an example of a typical manner of using the present design, the integrated apparatus 10 may be displayed and sold in its closed position. Prior to use, the user transforms the integrated apparatus 10 into its opened position by rotatably folding out the foldable trash disposal receptacle 14 away from the hollow dispensing container 12. The user will then lift the foldable receptacle lid 40 away from the back wall 32 of the trash disposal receptacle 14, possibly by using the pull tab 42 attached to the foldable receptacle lid 40. The user may then push one or more insertion tabs 48 into the corresponding tab insertion slits 50 in either or both the hollow dispensing container 12 or the trash disposal receptacle 14 to lock the integrated apparatus 10 and the foldable receptacle lid 40 in their positions. The user then can remove a tissue or like paper product from the aperture 28 of the hollow dispensing container, and dispose of the tissue through the tissue insertion slits 46 of the trash disposal receptacle 14 or by unlocking and opening the foldable receptacle lid 40. When desired, the user may then discard the entire integrated apparatus 10 or only the trash disposal receptacle 14 by separating the trash disposal receptacle 14 from the hollow dispensing container 12 along the perforated line 38. The user may also at any time separate the foldable receptacle lid 40 from the trash disposal receptacle 14 along the scored line 44.

Thus according to one embodiment, there is provided an integrated tissue dispensing apparatus. The apparatus includes a hollow dispensing container configured to hold at least one tissue, the hollow dispensing container comprising a front face, a top face, a back face positioned opposite to the front face, a left side face, a bottom face, and a right side face positioned opposite to the left side face, and a foldable trash disposal receptacle formed with and fixedly adjoined to the hollow dispensing container and comprising a receptacle bottom wall connected to the back face of the dispensing container. The foldable trash receptacle is configured to fold between a closed position and an open position relative to the dispensing container.

According to another embodiment, there is provided an integrated tissue dispensing apparatus comprising a multi-panel single semi-rigid foldable piece that when assembled forms a dispensing container having a front face, a top face, a back face positioned opposite the front face, a left side face, a bottom face positioned opposite the top face, and a right side face positioned opposite the left side face, and a foldable trash disposal receptacle having a receptacle bottom wall, a receptacle back wall, a receptacle left side wall, and a right side wall positioned opposite the left side wall, wherein the receptacle bottom wall is connected to the back face of the dispensing container such that the receptacle folds between a closed position and an open position relative to the dispensing container.

According to a further embodiment, there is provided an integrated tissue dispensing apparatus that includes a multi-panel single semi-rigid foldable piece that when assembled forms a hollow dispensing container having a front face, a top face, a back face opposite the front face, a left side face, a bottom face positioned opposite to the top face, and a right side face positioned opposite to the left side face, wherein said top face includes an aperture configured for removal of a tissue, and a foldable trash disposal receptacle having a receptacle bottom wall, a receptacle back wall, a receptacle left side wall, and a receptacle right side wall positioned opposite the receptacle left side wall. The receptacle bottom wall is connectably formed adjacent to the back face of the dispensing container using a perforated line such that the receptacle may fold between a closed position and an open position relative to the dispensing container.

According to another embodiment, there is provided a tissue dispensing container configured to hold at least one tissue, the tissue dispensing container comprising a front face, a top face, a back face positioned opposite to the front face, a left side face, a bottom face, and a right side face positioned opposite to the left side face, and a disposal receptacle formed with and fixedly adjoined to the hollow dispensing container and comprising a receptacle bottom wall connected to the back face of the dispensing container, the receptacle bottom wall formed with and fixedly adjoined to a receptacle back wall of the disposal receptacle. The disposal receptacle oriented is in a closed position covering the top face of the tissue dispensing container and is movable to an open position exposing the top face of the tissue dispensing container.

The foregoing description of specific embodiments reveals the general nature of the disclosure sufficiently that others can, by applying current knowledge, readily modify and/or adapt the structure without departing from the general concept. Therefore, such adaptations and modifications are within the meaning and range of equivalents of the disclosed embodiments. The phraseology or terminology employed herein is for the purpose of description and not of limitation.

What is claimed is:

1. An integrated tissue dispensing apparatus, comprising:

a tissue dispensing container configured to hold at least one tissue, the tissue dispensing container comprising a front face, a top face, a back face positioned opposite to the front face, a left side face, a bottom face, and a right side face positioned opposite to the left side face; and a disposal receptacle adjoined to the hollow dispensing container and comprising a receptacle bottom wall connected to the back face of the dispensing container, the receptacle bottom wall adjoining a receptacle back wall of the disposal receptacle at a joining line;

wherein the disposal receptacle is oriented in a closed position covering the top face of the tissue dispensing container and is rotatable about the joining line to an open position exposing the top face of the tissue dispensing container.

2. The integrated tissue dispensing apparatus of claim 1, wherein the disposal receptacle further comprises:

a receptacle left side wall connected to the receptacle back wall, a receptacle right side wall connected to the receptacle back wall and positioned opposite to the receptacle left side wall.

3. The integrated tissue dispensing apparatus of claim 2, wherein the closed position includes the left side face wholly interfacing with the receptacle left side wall, the right side face wholly interfacing with the receptacle right side wall, and the top face wholly interfacing with the receptacle back wall.

4. The integrated tissue dispensing apparatus of claim 3, wherein the opened position includes the back face perpendicular to the receptacle bottom wall, the back face parallel to the receptacle back wall, the left side face parallel to the receptacle left side wall, and the right side face parallel to the receptacle right side wall.

5. The integrated tissue dispensing apparatus of claim 1, wherein the receptacle bottom wall is connected to the back face of the tissue dispensing container by a perforated line along which the tissue dispensing container and the disposal receptacle may be separated into distinct sections.

6. The integrated tissue dispensing apparatus of claim 2, further comprising a foldable receptacle lid, wherein the foldable receptacle lid is rotatable and connected to the receptacle back wall and positioned opposite the receptacle bottom wall.

7. The integrated tissue dispensing apparatus of claim 6, wherein the foldable receptacle lid includes a pull tab positioned opposite to the back wall of the receptacle.

8. The integrated tissue dispensing apparatus of claim 6, wherein the foldable receptacle lid is connected to the receptacle back wall along a scored line providing for detachment of the receptacle lid from the receptacle.

9. The integrated tissue dispensing apparatus of claim 6, wherein the foldable receptacle lid includes one or more insertion tabs for interconnecting the foldable receptacle lid to one or more tab insertion slits in the integrated tissue dispensing apparatus.

10. An integrated tissue dispensing apparatus, comprising:

a tissue dispensing container having a front face, a top face, a back face positioned opposite the front face, a left side face, a bottom face positioned opposite the top face, and a right side face positioned opposite the left side face; and a disposal receptacle having a receptacle bottom wall, a receptacle back wall, a receptacle left side wall, and a right side wall positioned opposite the left side wall, the receptacle bottom wall adjoining the receptacle back wall of the disposal receptacle at a joining line;

wherein the disposal receptacle is oriented in a closed position covering the top face of the tissue dispensing container and is rotatable about the joining line to an open position exposing the top face of the tissue dispensing container.

11. The integrated tissue dispensing apparatus of claim 10, further comprising a foldable receptacle lid connected to the receptacle back wall.

12. The integrated tissue dispensing apparatus of claim 10, wherein the receptacle bottom wall is connected to the back face of the tissue dispensing container by a perforated line formed such that the tissue dispensing container and the disposal receptacle may be separated into distinct sections.

13. The integrated tissue dispensing apparatus of claim 11, wherein the foldable receptacle lid includes a pull tab positioned opposite to the receptacle back wall.

14. The integrated tissue dispensing apparatus of claim 11, wherein the foldable receptacle lid is connected to the receptacle back wall along a scored line, along which the receptacle lid may be detached from the disposal receptacle.

15. The integrated tissue dispensing apparatus of claim 11, wherein the foldable receptacle lid includes at least one insertion tab for interconnecting the foldable receptacle lid to at least one tab insertion slit.

16. An integrated tissue dispensing apparatus, comprising:

a dispensing container having a front face, a top face, a back face opposite the front face, a left side face, a bottom face positioned opposite to the top face, and a right side face positioned opposite to the left side face, wherein said top face includes an aperture configured for removal of a tissue; and a disposal receptacle having a receptacle bottom wall, a receptacle back wall, a receptacle left side wall, and a receptacle right side wall positioned opposite the receptacle left side wall, the receptacle bottom wall formed with and fixedly adjoined to the receptacle back wall of the disposal receptacle, the disposal receptacle oriented in a closed position covering the top face of the dispensing container and adjustable to an opened position exposing the top face of the dispensing container;

wherein the receptacle bottom wall is connectably formed adjacent to the back face of the dispensing container using a perforated line.

17. The integrated tissue dispensing apparatus of claim 16, wherein the closed position is such that the left side face wholly interfaces with the receptacle left side wall, the right side face wholly interfaces with the receptacle right side wall, and the top face wholly interfaces with the receptacle back wall.

18. The integrated tissue dispensing apparatus of claim 16, wherein the opened position is such that the back face is perpendicular to the receptacle bottom wall, the back face is parallel to the receptacle back wall, the left side face is parallel to the receptacle left side wall, and the right side face is parallel to the receptacle right side wall.

19. The integrated tissue dispensing apparatus of claim 16, further comprising a foldable receptacle lid, wherein the receptacle lid is connected to the receptacle back wall and is positioned opposite to the receptacle bottom wall.

20. The integrated tissue dispensing apparatus of claim 19, wherein the foldable receptacle lid includes a pull tab positioned opposite to the receptacle back wall, wherein the foldable receptacle lid is connected to the receptacle back wall along a scored line along which the receptacle lid may be detached from the disposal receptacle.

21. The integrated tissue dispensing apparatus of claim 19, wherein the foldable receptacle lid includes one or more insertion tabs for interconnecting the foldable receptacle lid to at least one tab insertion slit.

* * * * *